US008851614B2

(12) United States Patent
Owaki et al.

(10) Patent No.: US 8,851,614 B2
(45) Date of Patent: Oct. 7, 2014

(54) LIQUID EJECTION HEAD AND LIQUID EJECTION APPARATUS

(75) Inventors: Hiroshige Owaki, Okaya (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 170 days.

(21) Appl. No.: 13/413,619

(22) Filed: Mar. 6, 2012

(65) Prior Publication Data

US 2012/0229553 A1 Sep. 13, 2012

(30) Foreign Application Priority Data

Mar. 7, 2011 (JP) ..... 2011-049539

(51) Int. Cl.

| | |
|---|---|
| ***B41J 29/393*** | (2006.01) |
| ***B41J 2/045*** | (2006.01) |
| ***B41J 2/14*** | (2006.01) |
| ***B41J 2/055*** | (2006.01) |

(52) U.S. Cl.

CPC ..... *B41J 2/14233* (2013.01); *B41J 2/055* (2013.01); *B41J 2/04563* (2013.01); *B41J 2/04581* (2013.01); *B41J 2202/14241* (2013.01)

USPC ..... 347/19; 347/68

(58) Field of Classification Search

CPC .. B41J 2/04563; B41J 2/0454; B41J 2/14153; B41J 2002/14354

USPC ..... 347/19, 68

See application file for complete search history.

(56) References Cited

U.S. PATENT DOCUMENTS

| | | | | |
|---|---|---|---|---|
| 2006/0170735 | A1 * | 8/2006 | Hong et al. | 347/68 |
| 2009/0295854 | A1 * | 12/2009 | Kawakami et al. | 347/10 |
| 2010/0097428 | A1 * | 4/2010 | Owaki | 347/50 |

FOREIGN PATENT DOCUMENTS

| | | | |
|---|---|---|---|
| JP | 2004-345109 | A | 12/2004 |
| JP | 2006-205735 | A | 8/2006 |

* cited by examiner

*Primary Examiner* — Jason Uhlenhake

(74) *Attorney, Agent, or Firm* — Kilpatrick Townsend & Stockton LLP

(57) ABSTRACT

A liquid ejection head includes a nozzle plate on which nozzle openings for ejecting liquid are provided, a flow path formation substrate on which pressure generation chambers communicating with the nozzle openings are provided, communicating portions in which the liquid to be supplied to the pressure generation chambers is stored, and piezoelectric elements which generate pressure change in the liquid in the pressure generation chambers. In the liquid ejection head, a thermistor is arranged on a surface of the flow path formation substrate at an opposite side to the nozzle openings and one lead wiring of the thermistor is connected to wiring layers which are formed on the surface of the flow path formation substrate in a state where one side ends of the wiring layers face to the communicating portions.

17 Claims, 8 Drawing Sheets

LIQUID EJECTION HEAD AND LIQUID EJECTION APPARATUS

BACKGROUND

1. Technical Field

The present invention relates to a liquid ejection head and a liquid ejection apparatus. In particular, the invention is useful when being applied to a case where a drive waveform of the liquid ejection head is appropriately selected in order to control discharge characteristics in accordance with a temperature of liquid to be ejected.

2. Related Art

As an ink jet recording head as a representative example of a liquid ejection head which ejects liquid droplets, there is the following ink jet recording head, for example. That is, there is an ink jet recording head which includes a flow path formation substrate on which pressure generation chambers are formed, and piezoelectric actuators which are provided on one surface of the flow path formation substrate so as to correspond to the pressure generation chambers. Further, the ink jet recording head ejects ink droplets through nozzle openings, which are formed on a nozzle plate so as to penetrate through the nozzle plate in a thickness direction thereof, by applying a pressure into the pressure generation chambers with displacement of the piezoelectric actuators.

Discharge characteristics of ink by the ink jet recording head of this type depend on viscosity of the ink and the viscosity of the ink depends on a temperature thereof. Then, the following control is performed. That is, a drive waveform by which the piezoelectric actuators are driven is appropriately selected and changed in accordance with a temperature measured by a thermistor.

However, the existing thermistor is arranged on a circuit substrate as one of electric parts. Accordingly, in this case, the thermistor measures an ambient temperature, resulting in a large temperature difference between an actual temperature of ink to be discharged through the nozzle openings and the measured temperature.

In order to improve the discharge characteristics of ink, it is required to measure the temperature of ink to be discharged more accurately. Configurations disclosed in JP-A-2004-345109 and JP-A-2006-205735 have been proposed as devices for measuring a temperature of ink to be discharged through nozzle openings more accurately.

In JP-A-2004-345109, the recording head is formed by bonding a heat generation substrate and a flow path substrate and a temperature sensor is embedded in the heat generation substrate.

In JP-A-2006-205735, a thermistor as a temperature detection sensor is arranged on an upper surface of an insulating film while the thermistor and a lower electrode formed on a flow path formation substrate are ensured to be insulated from each other with the insulating film.

As described above, in JP-A-2004-345109, the temperature sensor is provided so as to be embedded in the heat generation substrate in a state where the temperature sensor makes contact with ink. Therefore, it may be considered that there is still a problem in that insulation of electrodes and the like thereof is not ensured. Further, in JP-A-2006-205735, the temperature detection sensor is arranged on the upper surface of the insulating film while the temperature detection sensor and the lower electrode formed on the flow path formation substrate are ensured to be insulated from each other with the insulating film. Therefore, there are problems in that a configuration of this portion is complicated and further temperature measuring accuracy is lowered because the temperature of ink is measured through the lower electrode film and the insulating film.

It is to be noted that the above problems arise not only in the ink jet recording head which discharges ink but also in a liquid ejection head which ejects liquid other than ink.

SUMMARY

An advantage of some aspects of the invention is to provide a liquid ejection head and a liquid ejection apparatus which include a temperature sensor that can measure a temperature of liquid to be discharged in order to discharge the liquid using an appropriate drive waveform in accordance with viscosity of the liquid.

A liquid ejection head according to an aspect of the invention includes a nozzle plate on which a nozzle opening for ejecting liquid is provided, a flow path formation substrate on which a pressure generation chamber communicating with the nozzle opening is provided, a liquid storing portion in which the liquid to be supplied to the pressure generation chamber is stored, and a pressure generation unit which causes pressure change in the liquid of the pressure generation chamber. In the liquid ejection head, a temperature sensor is arranged on a surface of the flow path formation substrate at an opposite side to the nozzle opening and one lead wiring of the temperature sensor is connected to a wiring which is formed on the surface of the flow path formation substrate in a state where one end of the wiring faces the liquid storing portion.

In the aspect of the invention, a temperature of liquid to be discharged through the nozzle opening is detected by the temperature sensor through the flow path formation substrate having a preferable heat conductivity. As a result, the temperature of the liquid can be measured with high accuracy. In addition, liquid stored in the liquid storing portion makes contact with the temperature sensor through the wiring and the one lead wiring. Therefore, the temperature of the liquid is directly transmitted to the temperature detection sensor through the wiring. With this, a temperature measurement to which an actual temperature of the liquid is reflected with high accuracy can be performed.

It is preferable that at least the one lead wiring of the temperature sensor be connected to one end of a COF substrate of which the one end is connected to a lead electrode of the pressure generation unit. In this case, temperature information measured by a temperature sensor can be preferably transmitted to a predetermined substrate or the like using the wiring of the COF substrate.

Further, it is preferable that the temperature sensor be arranged at a center portion of the flow path formation substrate. In this case, an average temperature of liquid is reflected on the center portion of the flow path formation substrate. Therefore, the center portion of the flow path formation substrate is optimum as a portion at which the temperature of the liquid is measured so as to measure temperature information with high accuracy.

Further, it is preferable that the wiring be formed by using a wiring layer which is formed by the same member as the lead electrode so as to close the liquid storing portion on the flow path formation substrate at an opposite side to the nozzle opening in a non-continuous manner to the lead electrode when the liquid storing portion is formed on the flow path formation substrate by etching and which is left in a process of ripping the closed portion after the etching has been completed. In this case, the temperature of liquid can be transmitted to the temperature sensor by effectively using a wiring layer formed in a so-called film ripping process when the flow path formation substrate of the liquid ejection head is manufactured. As a result, the wiring layer which is needed only when the flow path formation substrate is etched and is not needed after the film ripping process can be effectively used.

A liquid ejection apparatus according to another aspect of the invention includes the above liquid ejection head. In the liquid ejection apparatus, a drive waveform by which the pressure generation unit is driven is switchable based on a temperature detected by the temperature sensor.

In the aspect of the invention, temperature information representing a temperature of liquid to be discharged from the liquid ejection head can be detected with high accuracy. Therefore, the liquid ejection head can be driven in an appropriate drive waveform in accordance with the temperature information. As a result, a liquid ejection apparatus which can improve quality of a printed material or the like can be realized by improvement of discharge characteristics of the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention is described in detail based on embodiments.

Figure 1:
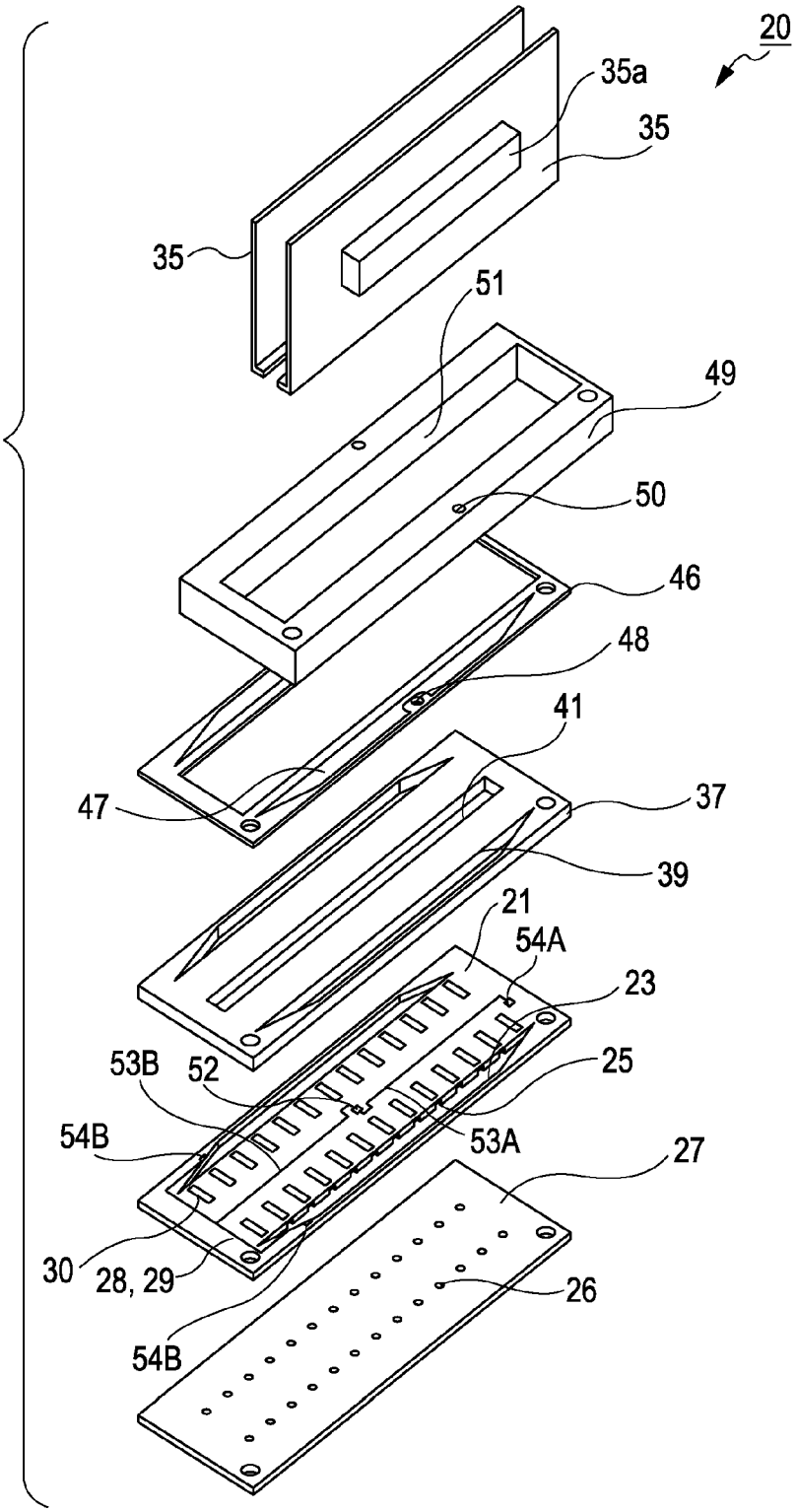
FIG. 1 is an exploded perspective view illustrating a recording head according to an embodiment.
Figure 2:
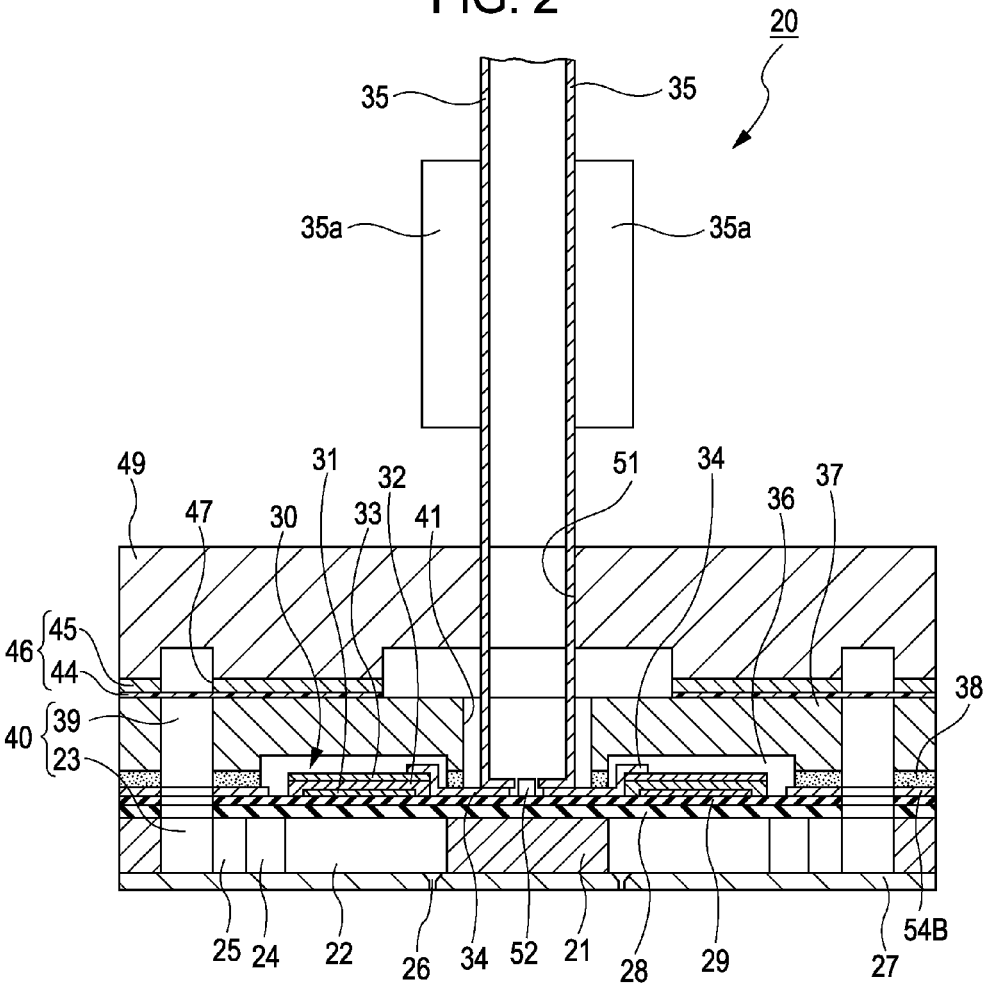
FIG. 2 is a cross-sectional view illustrating pressure generation chambers of the recording head in a lengthwise direction according to the embodiment.

FIG. 1 is an exploded perspective view illustrating an ink jet recording head (hereinafter, also referred to as "recording head" simply) according to an embodiment of the invention. FIG. 2 is a cross-sectional view illustrating pressure generation chambers in a lengthwise direction of the recording head.

As illustrated in FIG. 1 and FIG. 2, two rows of pressure generation chambers 22 are provided on a flow path formation substrate 21 constituting a recording head 20. The plurality of pressure generation chambers 22 are arranged in parallel in a width direction of the flow path formation substrate 21 on each row. Further, communicating portions 23 are formed on regions at outer sides of the rows of the pressure generation chambers 22 in the lengthwise direction thereof. The communicating portions 23 and the pressure generation chambers 22 communicate with each other through ink supply paths 24 and communicating paths 25. Note that each ink supply path 24 and each communicating path 25 are provided for each pressure generation chamber 22.

A nozzle plate 27 is bonded to one surface of the flow path formation substrate 21. Nozzle openings 26 are provided on the nozzle plate 27 in a punched manner so as to communicate with vicinities of ends of the respective pressure generation chambers 22 at the opposite side to the ink supply paths 24.

On the other hand, piezoelectric elements 30 are formed on a surface of the flow path formation substrate 21 at the opposite side to the nozzle plate 27. The piezoelectric elements 30 are formed on the surface of the flow path formation substrate 21 through an elastic film 28 and an insulating film 29. Each piezoelectric element 30 is constituted by a first electrode 31, a piezoelectric layer 32, and a second electrode 33. A lead electrode 34 which extends onto the insulating film 29 is connected to the second electrode 33 constituting each piezoelectric element 30. One ends of the lead electrodes 34 are connected to the second electrodes 33 and the other ends thereof are connected to COF substrates 35. A driving IC 35*a* for driving the piezoelectric elements 30 is mounted on each COF substrate 35. In this manner, the lead electrodes 34 are connected to one side ends of the COF substrates 35 and a circuit substrate (not illustrated) is connected to the other ends of the COF substrates 35. The circuit substrate is fixed to a case member (not illustrated) at an upper side of the recording head 20.

A protection substrate 37 is bonded onto the flow path formation substrate 21 on which the piezoelectric elements 30 having the above configuration are formed with an adhesive 38. The protection substrate 37 is bonded onto the flow path formation substrate 21 on a region opposed to the piezoelectric elements 30. The protection substrate 37 includes piezoelectric element holding portions 36 as spaces for protecting the piezoelectric elements 30. Further, manifold portions 39 are provided on the protection substrate 37. In the embodiment, each manifold portion 39 communicates with each communicating portion 23 of the flow path formation substrate 21 so as to constitute a manifold 40 as a common ink chamber to the pressure generation chambers 22.

Further, a through-hole 41 which penetrates through the protection substrate 37 in a thickness direction is provided on the protection substrate 37. The through-hole 41 is provided between the two piezoelectric element holding portions 36 in the embodiment. Further, a vicinity of an end of each lead electrode 34 drawn out from each piezoelectric element 30 is exposed into the through-hole 41.

Further, a compliance substrate 46 is bonded onto the protection substrate 37. The compliance substrate 46 is constituted by a sealing film 44 and a fixing plate 45. Note that the sealing film 44 is made of a material having flexibility and low rigidity and one side surfaces of the manifold portions 39 are sealed with the sealing film 44. Further, the fixing plate 45 is made of a hard material such as a metal. Regions of the fixing plate 45, which are opposed to the manifolds 40, correspond to openings 47 where the fixing plate 45 is completely removed in the thickness direction. Therefore, one side surfaces of the manifolds 40 are sealed only by the sealing film 44 having flexibility. Further, ink introduction ports 48 for introducing ink into the manifolds 40 are provided on the compliance substrate 46.

A head case 49 is fixed onto the compliance substrate 46. Ink introduction paths 50 are provided on the head case 49. The ink introduction paths 50 communicate with the ink introduction ports 48 so as to supply ink from a storage unit such as a cartridge to the manifolds 40. Further, a wiring member holding hole 51 is provided on the head case 49. The wiring member holding hole 51 communicates with the through-hole 41 provided on the protection substrate 37. One side ends of the COF substrates 35 are connected to the lead electrodes 34 in a state where the COF substrates 35 are inserted through the wiring member holding hole 51.

Figure 3:
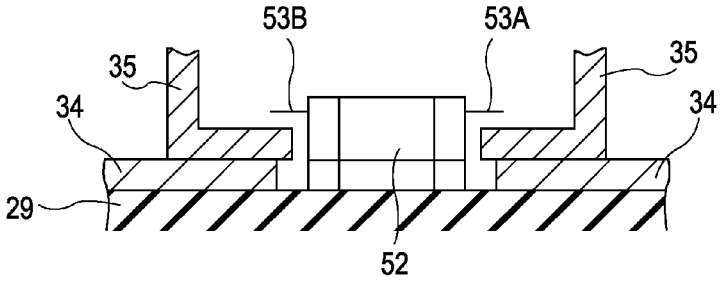
FIG. 3 is an enlarged view illustrating a thermistor portion in FIG. 2 in an extracted manner.
Figure 4:
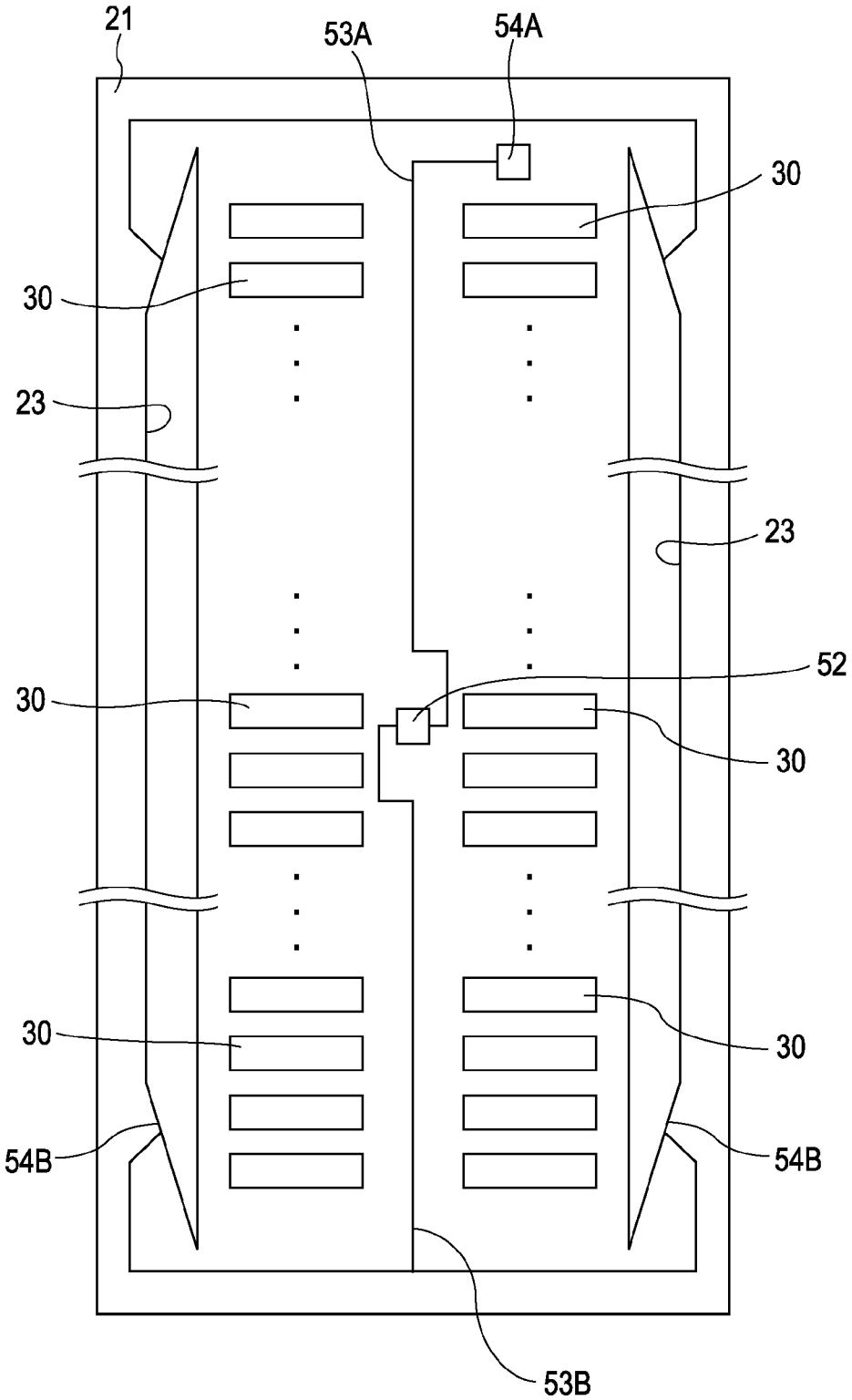
FIG. 4 is an enlarged view illustrating a flow path formation substrate in FIG. 1 when seen from the above.
Figure 5:
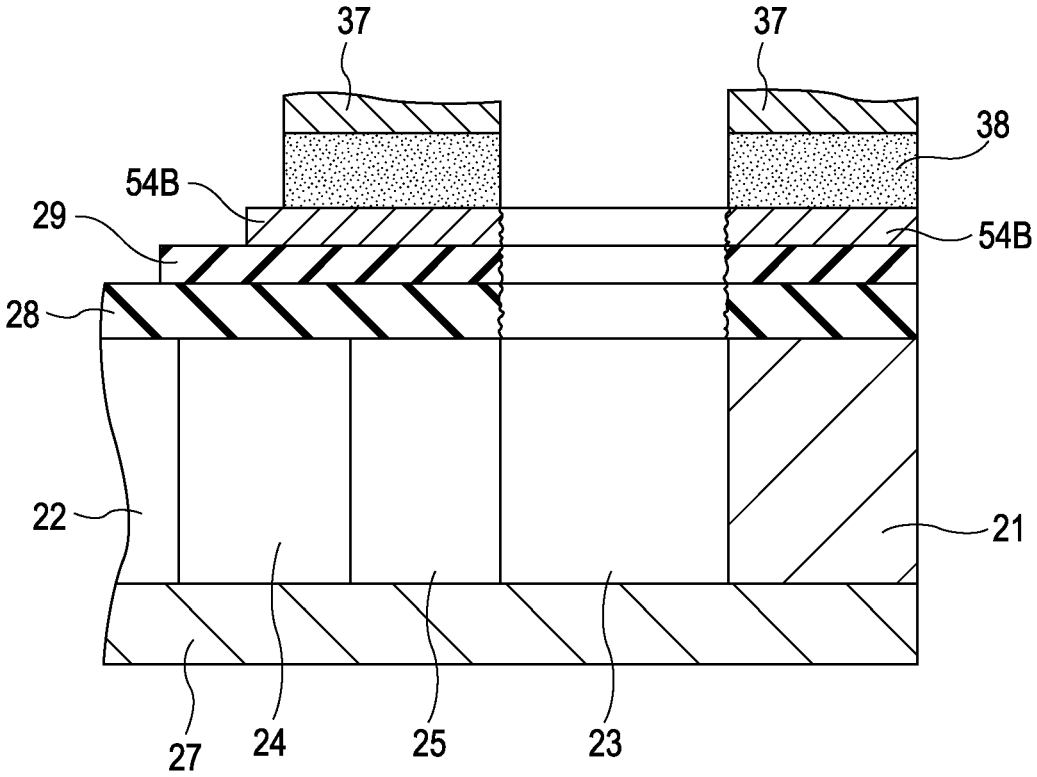
FIG. 5 is an enlarged view illustrating a manifold portion of the flow path formation substrate in FIG. 2.

As illustrated in FIG. 2, FIG. 3, and FIG. 4 in detail, a thermistor 52 as a temperature sensor is arranged at a center portion of a surface of the flow path formation substrate 21 at the opposite side to the nozzle plate 27. FIG. 3 is an enlarged view illustrating a thermistor portion in FIG. 2 in an extracted manner. FIG. 4 is an enlarged view illustrating the flow path formation substrate in FIG. 1 when seen from the above. One lead wiring 53A of the thermistor 52 is connected to a connection pad 54A at one outer side of the rows formed by the piezoelectric elements 30 on the flow path formation substrate 21 in the lengthwise direction. Further, the other lead wiring 53B of the thermistor 52 is connected to wiring layers 54B formed on the surface of the flow path formation substrate 21. One side ends of the wiring layers 54B face the communicating portions 23 of the manifolds 40, which correspond to a liquid storing portion. In the embodiment, the lead wiring 53B is connected to each of the wiring layers 54B, which faces each of the two communicating portions 23 formed so as to correspond to the rows of the piezoelectric elements 30. Note that it is sufficient that the lead wiring 53B is connected to either of the wiring layers 54B.

Further, in the embodiment, the lead wiring 53B of the thermistor 52 is grounded through the wiring layers 54B and ink in the manifolds 40 with which one side ends of the wiring layers 54B make contact. In this case, ink needs to be conductive and the ink needs to be at a ground potential. These needs can be preferably realized by forming the nozzle plate 27 with SUS as a conductive member or making needle-like members formed by a conductive member face into the manifolds 40 from the outside so as to make the needle-like members be at the ground potential, for example.

The connection pad 54A is connected to the COF substrates 35. That is to say, in the embodiment, one lead wiring 53A of the thermistor 52 is connected to an external wiring substrate (not illustrated) through the COF substrates 35 by using one wiring of the COF substrates 35, which supplies a predetermined driving signal to each piezoelectric element 30. Here, the thermistor 52 transmits a signal representing a resistance value corresponding to a temperature at a center portion of the flow path formation substrate 21 as a temperature signal. The resistance value also reflects a temperature of ink in the manifolds 40 through the wiring layers 54B, which is directly transmitted through the other lead wiring 53B. Accordingly, the thermistor 52 can detect a value to which the temperature of ink to be discharged through the nozzle openings 26 is reflected as a measurement value more accurately.

The wiring layers 54B in the embodiment are formed by using a film which closes the communicating portions 23 of the manifolds 40 at the opposite side to the nozzle openings 26 of the flow path formation substrate 21 when the communicating portions 23 are formed on the flow path formation substrate 21 by etching. To be more specific, the wiring layers 54B are formed by the film left in a process (film ripping process) of ripping the closed portions after the etching has been completed.

Here, a process relating to the film ripping process in a manufacturing process of the recording head 20 according to the embodiment is described. FIGS. 6A to 6C and FIGS. 7A to 7C are cross-sectional views illustrating a part of the manufacturing process of the recording head 20 according to the embodiment (only a part corresponding to right half of FIG. 2 is illustrated). It is to be noted that in FIGS. 6A to 6C and FIGS. 7A to 7C, the same reference numerals in FIG. 1 and FIG. 2 denote the same parts therein and overlapping description thereof is not repeated.

Figure 6A:
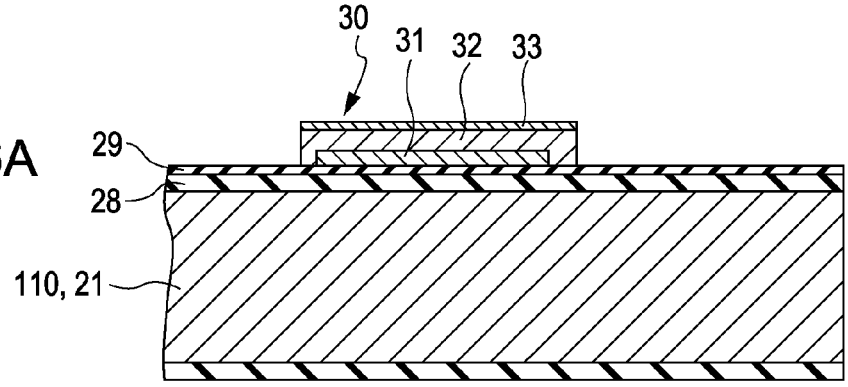
FIGS. 6A to 6C are cross-sectional views illustrating a part of a manufacturing process of the recording head according to the embodiment.
Figure 6B:
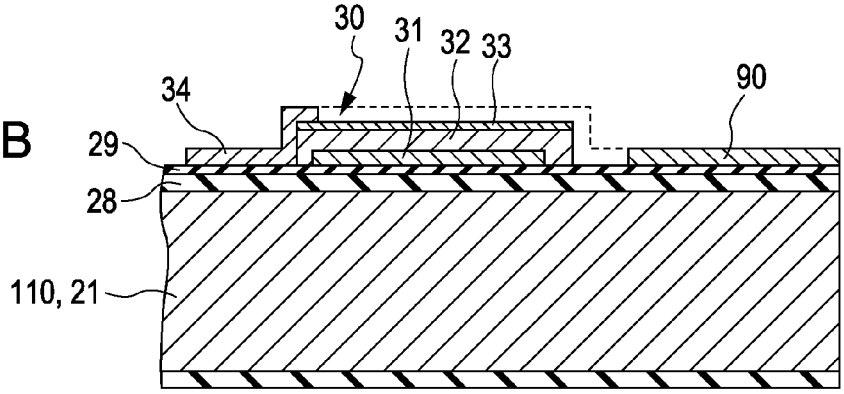

FIG. 6A illustrates a state where the elastic film 28, the insulating film 29 and the piezoelectric elements 30 are formed on a flow path formation substrate wafer 110 as a silicon wafer. The lead electrodes 34 are formed from such state. To be more specific, a wiring layer 90 is formed over the entire surface of the flow path formation substrate wafer 110 as illustrated in FIG. 6B. Then, a mask pattern (not illustrated) formed by a resist or the like is formed on the wiring layer 90 and the wiring layer 90 is patterned for each piezoelectric element 30 through the mask pattern. With this, the lead electrodes 34 are formed and the wiring layers 54B which are not continuous to the lead electrodes 34 are left on regions (on which the communicating portions 23 are formed later) corresponding to penetrating portions of the elastic film 28 so that the penetrating portions are sealed with the wiring layer 90.

Figure 6C:
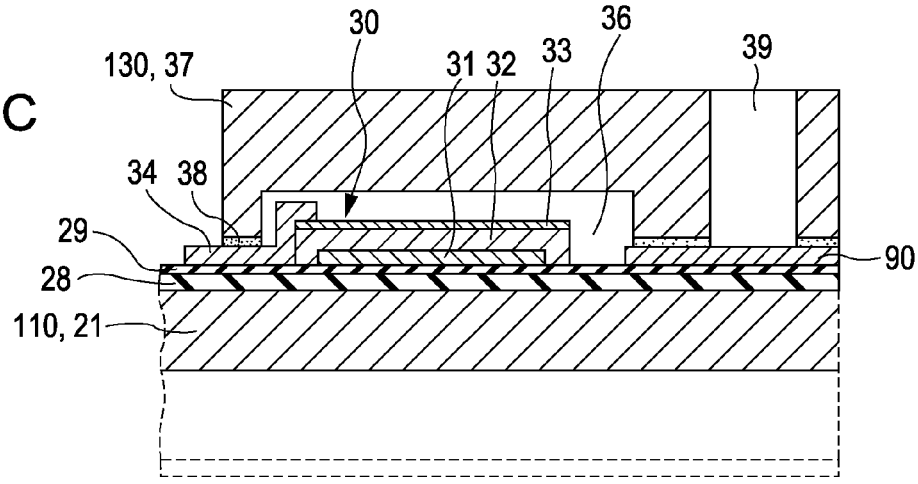

Next, as illustrated in FIG. 6C, a reservoir formation substrate wafer 130 is adhered onto the flow path formation substrate wafer 110 with the adhesive 38. Note that the manifold portions 39, the piezoelectric element holding portions 36, and the like are previously formed on the reservoir formation substrate wafer 130. Subsequently, the flow path formation substrate wafer 110 is made thinner to a predetermined thickness.

Figure 7A:
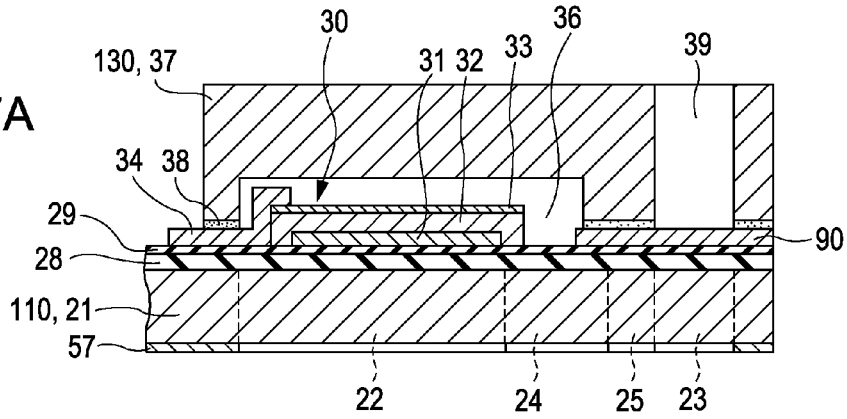
FIGS. 7A to 7C are cross-sectional views illustrating a part of the manufacturing process of the recording head according to the embodiment.
Figure 7B:
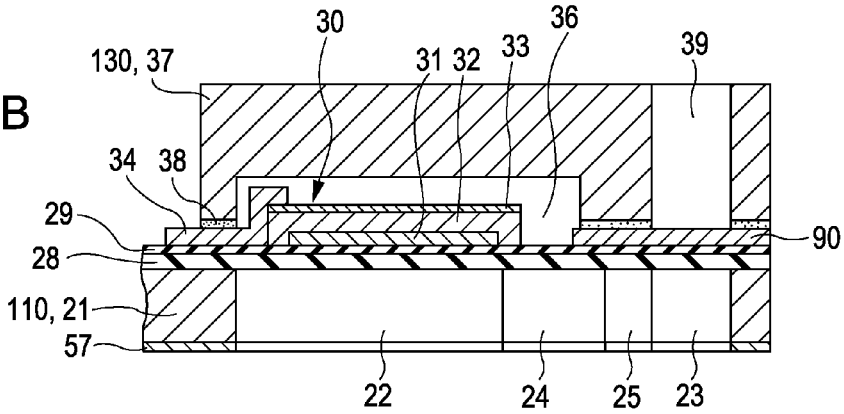

Thereafter, as illustrated in FIG. 7A, a mask film 57 is newly formed on the flow path formation substrate wafer 110 so as to be patterned into a predetermined shape. Then, as illustrated in FIG. 7B, the flow path formation substrate wafer 110 is anisotropically etched (wet-etched) through the mask film 57 so that the pressure generation chambers 22, the communicating portions 23, the ink supply paths 24 and the communicating paths 25 are formed on the flow path formation substrate wafer 110. Note that the wiring layer 90 seals opening ends of the manifold portions 39 at the side of the flow path formation substrate 21 so as to prevent an etchant for forming the communicating portions 23 from flowing into the manifold portions 39.

Figure 7C:
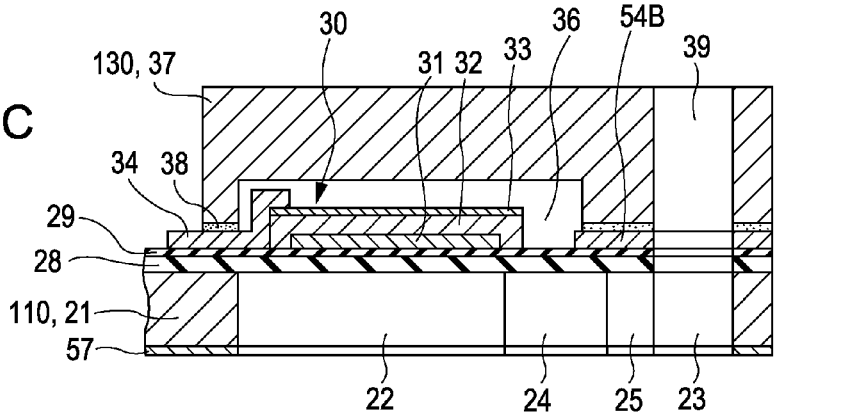

The manifolds 40 are formed after the pressure generation chambers 22, the communicating portions 23, the ink supply paths 24 and the communicating paths 25 have been formed on the flow path formation substrate wafer 110. Thereafter, as illustrated in FIG. 7C, the wiring layer 90 between the communicating portions 23 and the manifold portions 39 is removed (film-ripped) together with the elastic film 28 and the insulating film 29 so as to make the communicating portions 23 communicate with the manifold portions 39. As a result, the wiring layers 54B which are left around the communicating portions 23 in the film ripping process and of which ends face the communicating portions 23 are formed. In this manner, the wiring layers 54B are formed by the same material as that of the lead electrodes 34. Accordingly, the wiring layers 54B are good conductors and members having preferable heat conductivity.

In such recording head 20, the piezoelectric elements 30 are driven by a predetermined driving signal. As a result, ink droplets are discharged from the pressure generation chambers 22 through the nozzle openings 26 with a pressure generated in the pressure generation chambers 22. Temperature information to which an ink temperature is reflected is detected by the thermistor 52 arranged on the flow path formation substrate 21. Therefore, an appropriate driving signal is selected based on the temperature information so that the piezoelectric elements 30 can be driven with the selected driving signal. Note that the temperature detected by the thermistor 52 is a temperature to which the actual ink temperature is reflected with high accuracy because the thermistor 52 measures a temperature of the flow path formation substrate 21 which is normally formed by a silicon substrate and has preferable heat conductivity and heat of ink in the manifolds 40 is directly conducted to the lead wiring 53B. Accordingly, a driving signal based on the temperature information can be made to have an optimum waveform which reflects the ink temperature.

Figure 8:
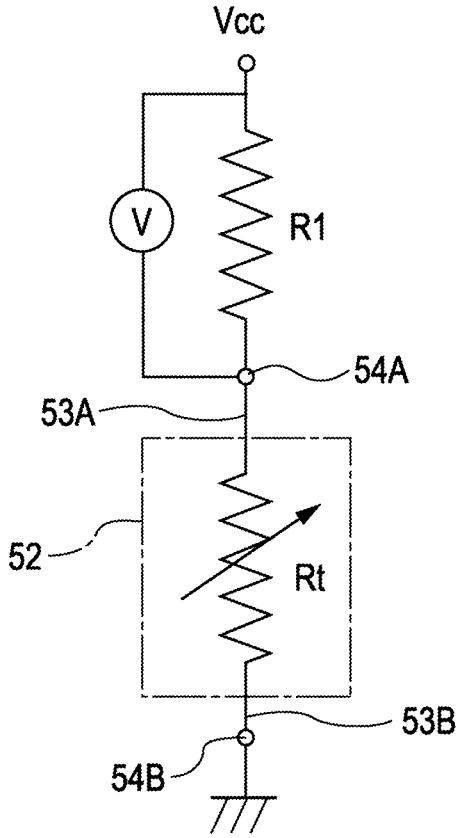
FIG. 8 is a circuit diagram illustrating an example of a circuit configuration of a temperature measurement device using a thermistor.

FIG. 8 is an example of an equivalent circuit of a portion of which temperature is to be measured in this case. As illustrated in FIG. 8, a fixed resistor R1 is connected to the thermistor 52 in series. The thermistor 52 is a variable resistor Rt of which resistance value is changed with a temperature. Accordingly, a temperature to be measured can be detected through a resistance value of the variable resistor Rt by measuring a voltage across both ends of the fixed resistor R1 with a voltmeter V for the following reason. That is, the voltage which is measured by the voltmeter is given as a value obtained by dividing a power-supply voltage Vcc at a division ratio determined by the resistance value of the fixed resistor R1 and that of the variable resistor Rt.

Other Embodiments

An embodiment of the invention has been described above. However, a basic configuration of the invention is not limited to the above configuration. For example, in the above embodiment, the lead wiring 53B of the thermistor 52 is connected to the wiring layers 54B only and is grounded through ink. However, it is needless to say that the lead wiring 53B of the thermistor 52 may be grounded through an external wiring substrate (not illustrated) through the COF substrates 35 by using one wiring of the COF substrates 35 in the same manner as the lead wiring 53A. In this case, the wiring layers 54B may be potentially in isolated states. Further, in the above embodiment, only one thermistor 52 is arranged at the center portion of the flow path formation substrate 21. However, the number and an arrangement position of the thermistor 52 are not particularly limited as long as the thermistor 52 is arranged on the surface of the flow path formation substrate 21.

In the above embodiment, the thin film-type piezoelectric elements 30 are used as a pressure generation unit for generating pressure change in the pressure generation chambers 22. However, the pressure generation unit is not particularly limited thereto. For example, a thick film-type piezoelectric actuator formed by a method of bonding a green sheet, or the like, a longitudinal vibration-type piezoelectric actuator on which piezoelectric materials and electrode formation materials are alternately laminated so as to extend and contract them in an axial direction, or the like, can be used. Further, a configuration in which heat generation elements are arranged in the pressure generation chambers so as to discharge liquid droplets through nozzle openings with bubbles to be generated by heat generation of the heat generation elements can be employed as the pressure generation unit. Alternatively, a so-called electrostatic actuator which generates static electricity between a vibration plate and an electrode and deforms the vibration plate with the electrostatic force so as to discharge liquid droplets through nozzle openings can be used as the pressure generation unit.

Figure 9:
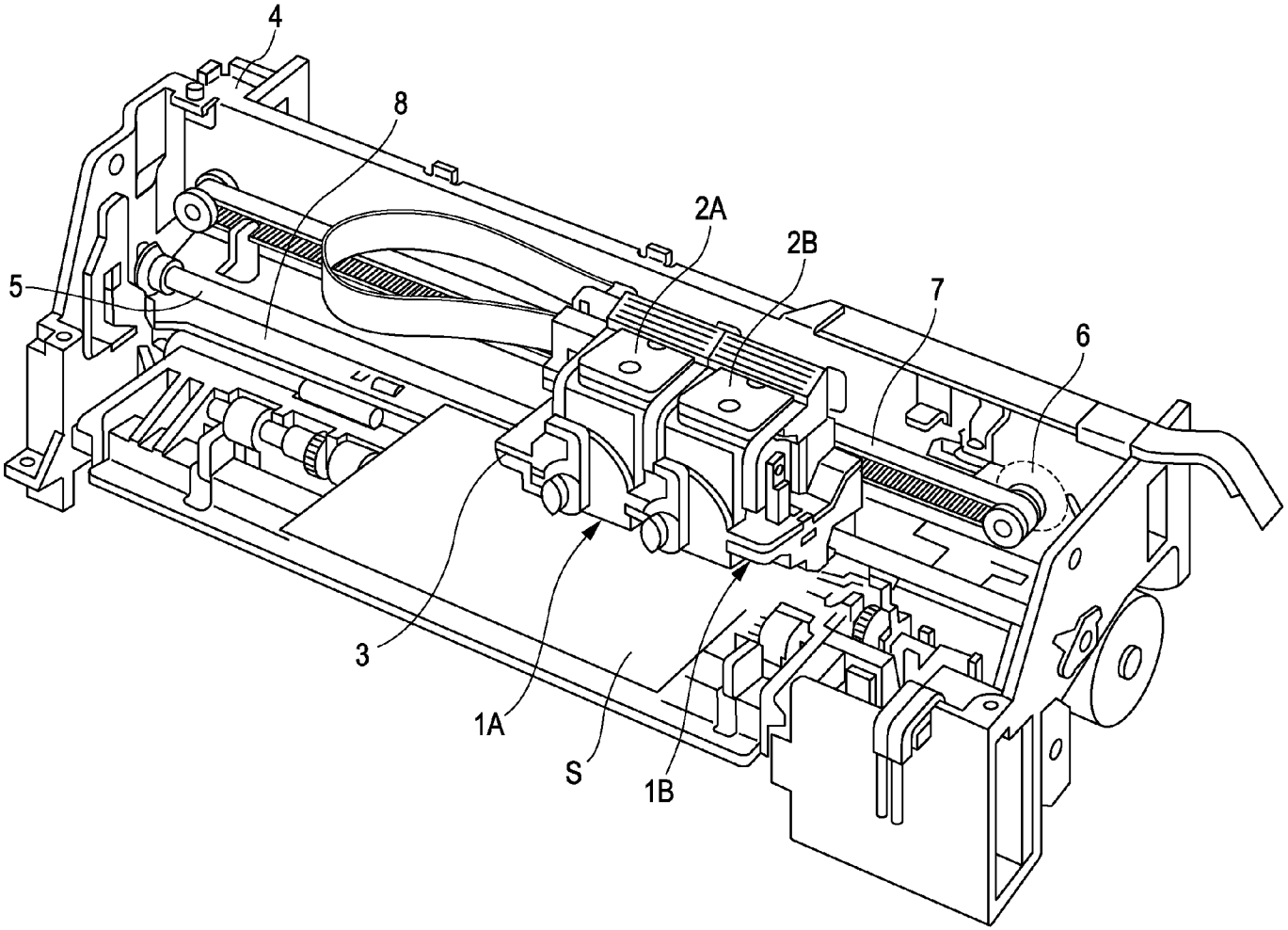
FIG. 9 is a schematic view illustrating an example of an ink jet recording apparatus according to an embodiment.

The ink jet recording head according to the above embodiment constitutes a part of a recording head unit including an ink flow path communicating with an ink cartridge and the like and is mounted on an ink jet recording apparatus. FIG. 9 is a schematic view illustrating an example of the ink jet recording apparatus. As illustrated in FIG. 9, cartridges 2A, 2B constituting an ink supply unit are provided on recording head units 1A, 1B each having the ink jet recording head according to the above embodiment in a detachable manner. A carriage 3 on which the recording head units 1A, 1B are mounted is provided on a carriage shaft 5 attached to an apparatus main body 4 in a movable manner in the shaft direction. The recording head units 1A, 1B discharge black ink composition and color ink composition, respectively, for example.

Further, a driving force of a driving motor 6 is transmitted to the carriage 3 through a plurality of gears (not illustrated) and a timing belt 7. With this, the carriage 3 on which the recording head units 1A, 1B are mounted is moved along the carriage shaft 5. On the other hand, a platen 8 is provided on the apparatus main body 4 along the carriage shaft 5 and a recording sheet S as a recording medium, such as a paper, which has been fed by a paper feeding roller (not illustrated) and the like is wound around the platen 8 so as to be transported.

In the example as described above, a so-called serial-type ink jet recording apparatus in which the recording head units 1A, 1B are mounted on the carriage 3 which moves in a direction (main scanning direction) intersecting with a transportation direction of the recording sheet S and printing is performed while moving the recording head units 1A, 1B in the main scanning direction. However, the invention is not particularly limited thereto. It is needless to say that the invention can be applied to a so-called line-type ink jet recording apparatus in which a recording head is fixed and printing is performed only by transporting the recording sheet S.

Further, in the above embodiment, the ink jet recording apparatus has been described as an example of a liquid ejection apparatus. However, the invention is widely applied to liquid ejection apparatuses including liquid ejection heads and it is needless to say that the invention can be also applied to a liquid ejection apparatus including a liquid ejection head which ejects liquid other than ink. As other liquid ejection heads, various recording heads used for an image recording apparatus such as a printer, a color material ejection head used for manufacturing a color filter such as a liquid crystal display, an electrode material ejection head used for forming an electrode such as an organic EL display and a field emission display (FED), a bioorganic compound ejection head used for manufacturing a bio chip, and the like can be exemplified.

The entire disclosure of Japanese Patent Application No. 2011-049539, filed Mar. 7, 2011 is incorporated by reference herein.

What is claimed is:

1. A liquid ejection head comprising:

a nozzle plate defining a nozzle opening for ejecting liquid;

a flow path substrate defining a pressure generation chamber communicating with the nozzle opening;

a liquid storing portion configured for the liquid to be stored therein and to be supplied to the pressure generation chamber therefrom;

a pressure generation unit configured to generate pressure change in the liquid in the pressure generation chamber;

a lead electrode of the pressure generation unit;

a temperature sensor disposed on a surface of the flow path substrate at an opposite side to the nozzle opening;

a lead wiring of the temperature sensor; and a wiring disposed on the surface of the flow path substrate, wherein the wiring is connected to the lead wiring of the temperature sensor, and wherein one end of the wiring faces the liquid storing portion;

wherein the wiring and the lead electrode of the pressure generation unit are formed by the same member and separated by etching.

2. The liquid ejection head according to claim 1, further comprising a COF substrate comprising a first and a second end, wherein the lead wiring of the temperature sensor is connected to the first end of the COF substrate , and wherein the second end of the COF substrate is connected to the lead electrode of the pressure generation unit.

3. A liquid ejection apparatus comprising the liquid ejection head according to claim 2, wherein a drive waveform by which the pressure generation unit is driven is switchable based on a temperature detected by the temperature sensor.

4. The liquid ejection head according to claim 1, wherein the temperature sensor is disposed at a center portion of the flow path substrate.

5. A liquid ejection apparatus comprising the liquid ejection head according to claim 4, wherein a drive waveform by which the pressure generation unit is driven is switchable based on a temperature detected by the temperature sensor.

6. The liquid ejection head according to claim 1, wherein the wiring is formed by using a wiring layer which is formed by the same member as the lead electrode so as to close the liquid storing portion on the flow path substrate at an opposite side to the nozzle opening in a non-continuous manner to the lead electrode when the liquid storing portion is formed on the flow path substrate by etching and which is left in a process of ripping the closed portion after the etching has been completed.

7. A liquid ejection apparatus comprising the liquid ejection head according to claim 6, wherein a drive waveform by which the pressure generation unit is driven is switchable based on a temperature detected by the temperature sensor.

8. A liquid ejection apparatus comprising the liquid ejection head according to claim 1, wherein a drive waveform by which the pressure generation unit is driven is switchable based on a temperature detected by the temperature sensor.

9. A liquid ejection head comprising:

a nozzle plate defining a nozzle opening for ejecting liquid;

a flow path substrate defining a pressure generation chamber communicating with the nozzle opening;

a liquid storing portion configured for the liquid to be stored therein and to be supplied to the pressure generation chamber therefrom;

a pressure generation unit configured to generate pressure change in the liquid in the pressure generation chamber;

a temperature sensor disposed on a surface of the flow path substrate at an opposite side to the nozzle opening;

a lead wiring of the temperature sensor; and a wiring disposed on the surface of the flow path substrate, wherein the wiring is connected to the lead wiring of the temperature sensor, and wherein one end of the wiring is immediately adjacent the liquid storing portion.

10. The liquid ejection head according to claim 9, wherein the one end of the wiring is in direct electrical and thermal communication with the liquid storing portion.

11. The liquid ejection head according to claim 9, further comprising:

a lead electrode of the pressure generating unit; and a COF substrate comprising a first and a second end;

wherein the lead wiring of the temperature sensor is connected to the first end of the COF substrate, and wherein the second end of the COF substrate is connected to the lead electrode of the pressure generation unit.

12. A liquid ejection apparatus comprising the liquid ejection head according to claim 11, wherein a drive waveform by which the pressure generation unit is driven is switchable based on a temperature detected by the temperature sensor.

13. The liquid ejection head according to claim 9, wherein the temperature sensor is disposed at a center portion of the flow path substrate.

14. A liquid ejection apparatus comprising the liquid ejection head according to claim 13, wherein a drive waveform by which the pressure generation unit is driven is switchable based on a temperature detected by the temperature sensor.

15. The liquid ejection head according to claim 9, further comprising a lead electrode of the pressure generating unit, wherein the wiring is formed by using a wiring layer which is formed by the same member as the lead electrode so as to close the liquid storing portion on the flow path substrate at an opposite side to the nozzle opening in a non-continuous manner to the lead electrode when the liquid storing portion is formed on the flow path substrate by etching and which is left in a process of ripping the closed portion after the etching has been completed.

16. A liquid ejection apparatus comprising the liquid ejection head according to claim 15, wherein a drive waveform by which the pressure generation unit is driven is switchable based on a temperature detected by the temperature sensor.

17. A liquid ejection apparatus comprising the liquid ejection head according to claim 9, wherein a drive waveform by which the pressure generation unit is driven is switchable based on a temperature detected by the temperature sensor.

* * * * *